US006637252B2

(12) United States Patent
Gaggl

(10) Patent No.: US 6,637,252 B2
(45) Date of Patent: Oct. 28, 2003

(54) MANUFACTURING DEVICE, IN PARTICULAR A FOLDING PRESS

(75) Inventor: Josef Gaggl, Steyr (AT)

(73) Assignee: Trumpf Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 10/211,995

(22) Filed: Aug. 2, 2002

(65) Prior Publication Data

US 2003/0061856 A1 Apr. 3, 2003

Related U.S. Application Data

(63) Continuation of application No. PCT/AT01/00024, filed on Jan. 31, 2001.

(30) Foreign Application Priority Data

Feb. 3, 2000 (AT) ..... 171/2000

(51) Int. Cl.[7] ..... B21D 5/02

(52) U.S. Cl. ..... 72/389.6; 72/453.06; 72/453.08; 100/231

(58) Field of Search ..... 72/455, 389.3, 72/389.6, 389.4, 453.06, 453.08; 100/231

(56) References Cited

U.S. PATENT DOCUMENTS 3,327,515 A * 6/1967 Beyeler ..... 72/453.08
3,677,009 A * 7/1972 Thatcher ..... 72/453.06
3,852,991 A * 12/1974 Poggio ..... 72/389.3
5,012,661 A 5/1991 Catti et al. ..... 72/389.6
5,067,340 A * 11/1991 MacGregor ..... 72/389.5
5,329,795 A * 7/1994 Sartorio et al. ..... 100/231
5,390,520 A * 2/1995 Hermes et al. ..... 72/453.08

FOREIGN PATENT DOCUMENTS

JP 10 180449 A 7/1998

* cited by examiner

*Primary Examiner*—David B. Jones
(74) *Attorney, Agent, or Firm*—Alston & Bird LLP

(57) ABSTRACT

The invention describes a production machine (1), in particular an edging press (2), preferably for shaping sheet metal parts (3) for making housing parts, sections (4), etc, with a machine frame (5) having C-shaped supporting side plates (6, 7) and at least one wall part (13) spacing the supporting side walls (6, 7) at a distance (11) apart from one another and permanently joined thereto. Mounted on the machine frame (5) so as to be non-displaceable is a press beam (15) on which a bending tool (36) can be mounted. Lying opposite it is another press beam (16), on which a bending tool (37) can also be mounted, displaceable in a guide arrangement (30) of the machine frame (5) by means of a drive arrangement (27). An actuator drive (25, 26) drivingly connected to the displaceable press beam (16) is preferably provided respectively on opposing side faces (22, 23) of each of the supporting side walls (6, 7).

16 Claims, 4 Drawing Sheets

MANUFACTURING DEVICE, IN PARTICULAR A FOLDING PRESS

CROSS-REFERENCE TO RELATED APPLICATION

This application is a continuation of International Patent Application No. PCT/AT01/00024 filed Jan. 31, 2001, now inactive.

FIELD OF THE INVENTION

The invention relates to a manufacturing device, of the type outlined in the generic part of claim 1.

BACKGROUND OF THE INVENTION

Production machines of this type known from the prior art come in a whole range of sizes in the form of edging presses with a drive arrangement, disposed at the centre or in the region of respective side plates of the machine frame, for a displaceable press beam, which is mounted on the machine frame in the region of the side plates and can be fitted with a bending tool. Depending on the machine type, the actuator drives are designed to produce a predetermined maximum shaping. To ensure that production is economical, e.g. for making mass-produced parts, production machines of this type, operated with a pressurizing medium, e.g. hydraulic oil, are provided with very large hydraulic cylinders which require a high pumping output to produce short cycle times because of their large volume.

The objective of the invention is to propose a production machine, in particular an edging press, for at least two output ranges selectable to requirements, which is energy-efficient and of a machine structure that is simple and cost-effective.

This objective is achieved by the invention in certain embodiments, wherein actuator drives in the form of hydraulic cylinders are mounted on opposite side faces of the side plates of the machine frame. The surprising advantage of the solution proposed by the invention resides in the fact that, set up to meet the respective processing requirements, the drive arrangements can be activated differently in order to obtain a minimum cycle time, whereby the return stroke, in other words the idle stroke of the press beam, can be displaced to top dead centre by applying pressure to only one cylinder pair, thereby producing a lower power requirement or a higher speed.

In another embodiment of the invention, a uniform load distribution can be obtained in standard machine frames without the need for machine components that would increase the cost of this type of structure.

Further embodiments offer the advantage of a high degree of flexibility when using production systems of this type.

As a result of other advantageous embodiments of the invention, the reaction force acting against the pressing force is introduced directly in the supporting side plates, thereby avoiding complex fixing arrangements to disperse the force and facilitating mounting and assembly of the actuator drives on the machine frame and supporting side plates.

Another possible embodiment allows other standard and inexpensive structural designs known from the prior art to be used.

Finally, certain embodiments are of advantage because they reduce the mounting and installation requirements inherent in producing pressure-tight line connections.

BRIEF DESCRIPTION OF THE DRAWINGS

The invention will be described in more detail with reference to examples of embodiments illustrated in the appended drawings.

Of these.

DETAILED DESCRIPTION OF PREFERRED EMBODIMENTS

Figure 1:
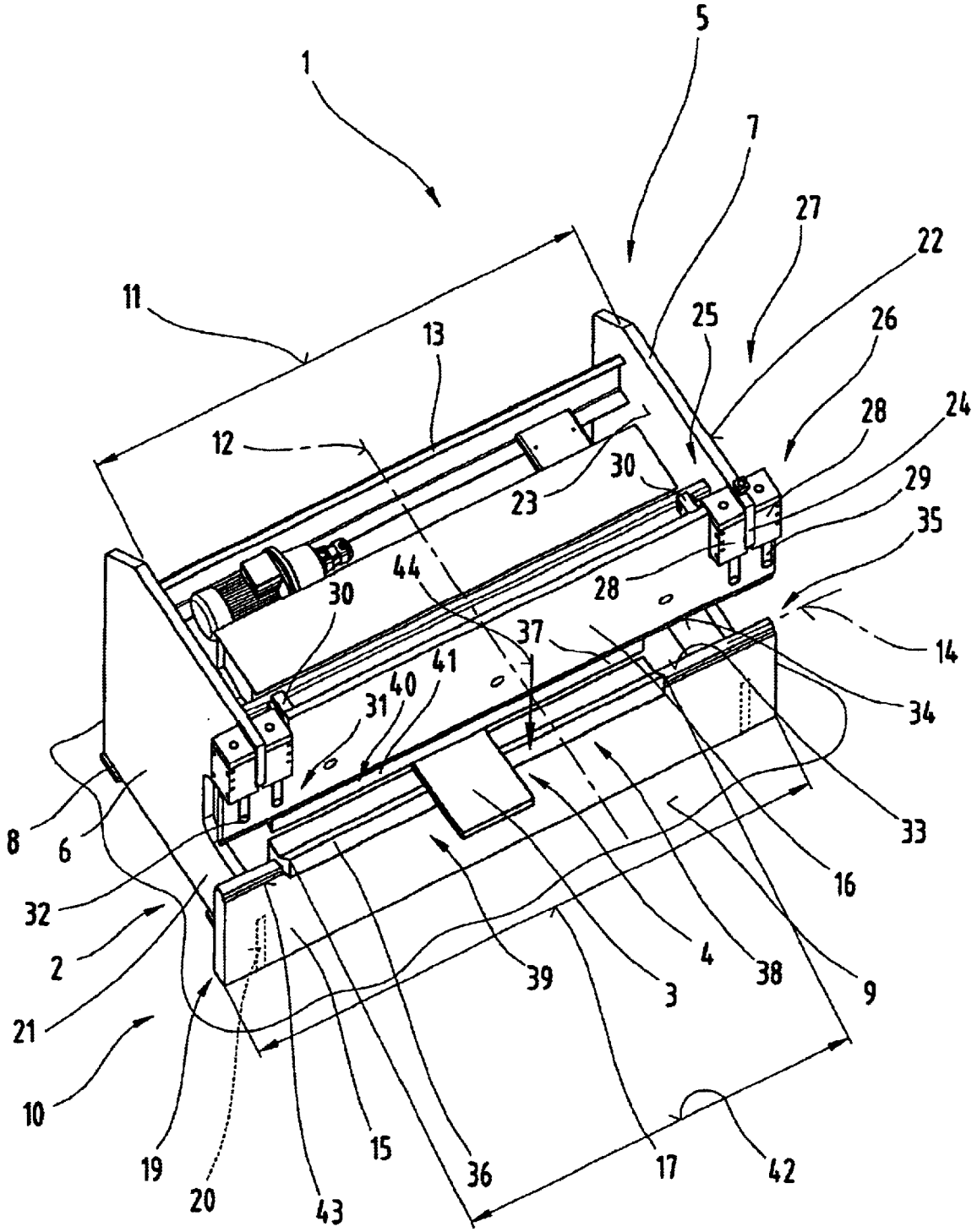
FIG. 1 is a schematic diagram illustrating a production machine as proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates a production machine 1, in particular an edging machine 2, for shaping sheet metal parts 3, e.g. to make housing parts, sections, etc. Production machines 1 of this type are specifically used to make elongate sections 4, e.g. an angled section, U-section, Z-section, etc., where the lengths involved are generally long relative to the cross-sectional dimension.

A machine frame 5 of the production machine 1 essentially consists of two parallel C-shaped supporting side plates 6, 7, spaced at a distance apart from one another, which are supported directly, or if necessary via damping elements 8 for example, on a standing surface 9 or in another embodiment, as illustrated, mounted on a common bed plate 10, in particular welded to it. The supporting side plates 6, 7, are also joined to one another by means of wall parts 13 extending in a space 11 perpendicular to a mid-plane 12.

By reference to a working plane 14 running parallel with the standing surface 9, the production machine 1 has two press beams 15, 16 lying opposite one another, which extend across a length 17 that is generally determined by the size of the machine or the working length provided for bending the sheet metal parts 3.

The press beam 15 facing the standing surface 9 is secured to the machine frame 5 by means of a fixing arrangement 19, preferably directly on end faces 20 of legs 21 of the C-shaped side plates 6, 7 assigned to the bed plate 10, in particular by means of a weld joint. Arranged on side faces 22, 23 of legs 24 of the C-shaped supporting side plates 6, 7 and spaced at a distance from the standing surface 9, are actuator drives 25, 26 of the drive arrangement 27, actuatable by a pressurising medium, provided in the form of double acting hydraulic cylinders 28. Actuator elements 29, e.g. piston rods, of the hydraulic cylinders 28, are drivingly linked, for example by means of articulated bearings 31 and bolts 32, to the press beam 16, which is mounted so as to be displaceable in guide arrangements 30 of the machine frame 5 in a direction running-perpendicular to the working plane 14.

The press beam 15 and the press beam 16 extend across the length 17 in a more or less symmetrical arrangement and in a direction perpendicular to the mid-plane 12, the length 17 being slightly longer than the distance 11.

On end faces 33, 34 directed towards one another and running parallel with the working plane 14, the press beams 15, 16 have tool holder devices 35 for supporting and releasably attaching bending tools 36, 37. In a manner known from the prior art, these bending tools 36, 37 are generally provided as a swage 39 in the form of a die 38 and a punch 40 in the form of a stamp 41. Also in a manner known from the prior art, the bending tools 36, 37 are divided into sections, so that the tool length 42 can be readily varied to adapt them to different requirements and facilitate re-fitting of the production machine 1 or changing bending tools 36, 37.

The tool holder devices 35 in the press beams 15, 16 are, firstly, designed for releasably attaching the bending tools 36, 37 and, secondly, constitute the supporting surfaces 43 for transmitting the bending forces—as indicated by arrow 44.

Figure 2:
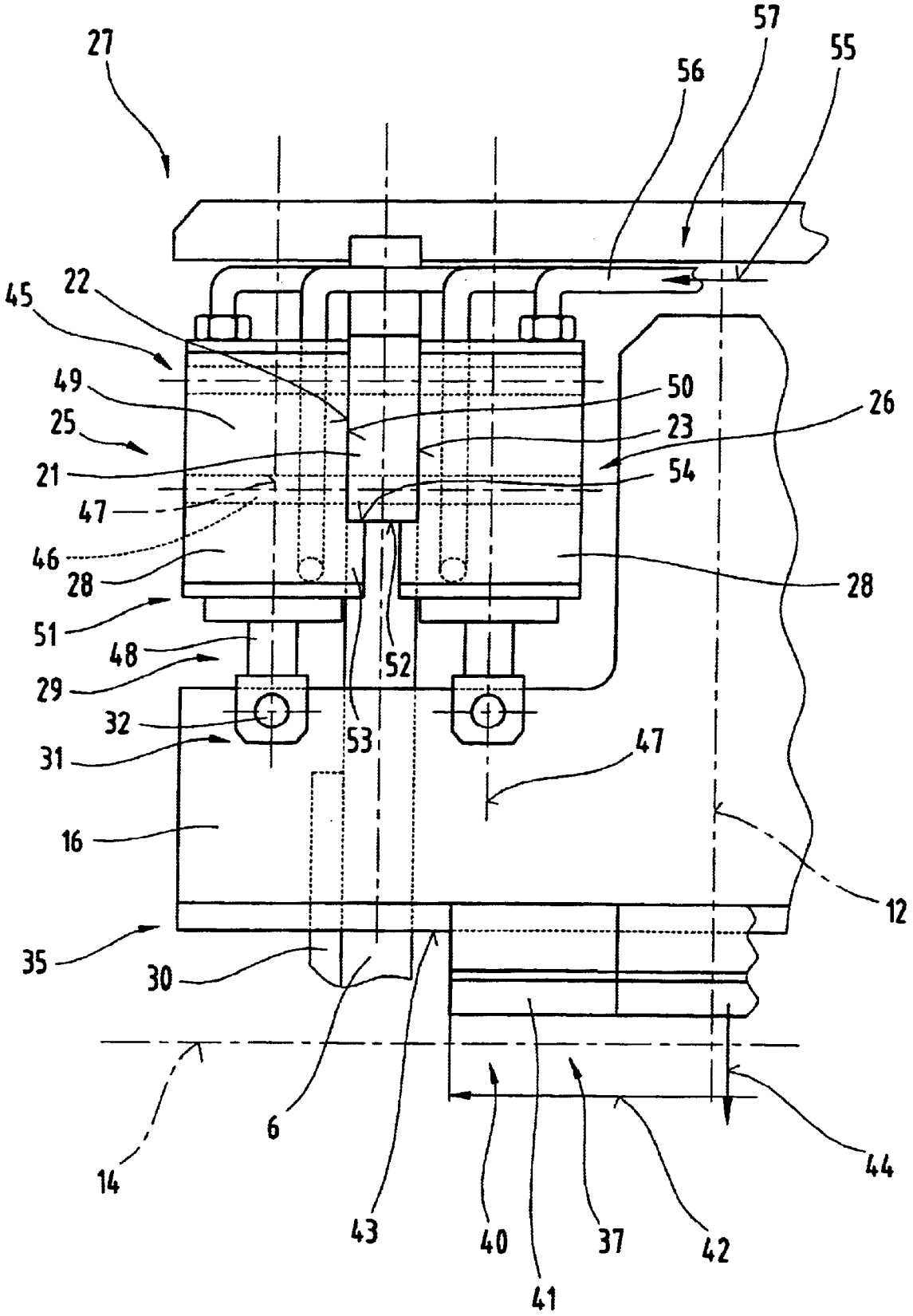
FIG. 2 is a view showing a part region of the production machine proposed by the invention with the drive arrangement.

FIG. 2 illustrates a preferred embodiment of the drive arrangement 27. It is shown in the region of the supporting side wall 6. The same design is provided in a symmetrical arrangement, by reference to the mid-plane 12, in the region of the other supporting side wall 7, although this is not illustrated in detail.

The actuator drives 25, 26, e.g. the hydraulic cylinders 28, are fixed to the side faces 22, 23 of the legs 21 by means of fixing elements 45, e.g. screws 46, with longitudinal mid-axes 47 extending perpendicular to the working plane 14. Piston rods 48 of the hydraulic cylinders 28 are linked to the press beam 16 via articulated bearings 31. In the embodiment illustrated as an example here, a cylinder jacket 49 is of a substantially quadrangular shape in external cross section. A side face 50 abuts directly with the side face 22, respectively the side face 23, of the leg 21 of the supporting side plate 6. An end region 51 of the cylinder jacket 49 facing the working plane 14 projects beyond a supporting surface 52 of the leg 21, facing and extending parallel with the working plane 14. Certain regions of the supporting surface 52 are overlapped by a strip-shaped projection 53 projecting beyond the side face 50 of the cylinder jacket 49 and forming a bearing surface 54 facing the supporting surface 52, as a result of which the reaction force acting on the hydraulic cylinder 28 in the direction opposite the pressing force is transmitted into the leg 21 of the supporting side plate 6—as indicated by arrow 44—so that no shearing forces act on the fixing elements 45 linking the hydraulic cylinder 28 to the leg 21. The strip-shaped projection 53 is preferably integrally formed on the cylinder jacket 49. Naturally, it would also be possible to use other cylinder structures known from the prior art and the way in which they are anchored and secured is also not restricted to the embodiment described here.

As also illustrated in this embodiment, the hydraulic cylinders 28 disposed on either side of the supporting side walls 6 are of the same dimensions, i.e. designed to produce equal displacement forces. Pressurising medium is applied to the hydraulic cylinders 28 via lines 56—as indicated by arrow 55—from a schematically indicated supply and control system 57.

Naturally, it would also be possible to provide an embodiment with differently dimensioned hydraulic cylinders 28, in which case the pairs of hydraulic cylinders arranged symmetrically on the production machine relative to the mid-plane 12 will be preferably be of the same dimensions.

Pressurising medium is applied to the hydraulic cylinders 28—as indicated by arrow 55—from the supply and control system 57 selectively, but at least to pairs of hydraulic cylinders 28 arranged symmetrically relative to the mid-plane 12, or commonly to all hydraulic cylinders 28. This allows the energy usage to be adapted to requirements and cycle times for the production of workpieces to be optimised, due to the possibility of applying pressure during the working stroke depending on the power requirement of all hydraulic cylinders 28 and applying pressure to only a part of the hydraulic cylinders 28 on the return stroke, thereby generating higher speeds for a predetermined output of the supply pump or by applying a higher return force as required.

Figure 3:
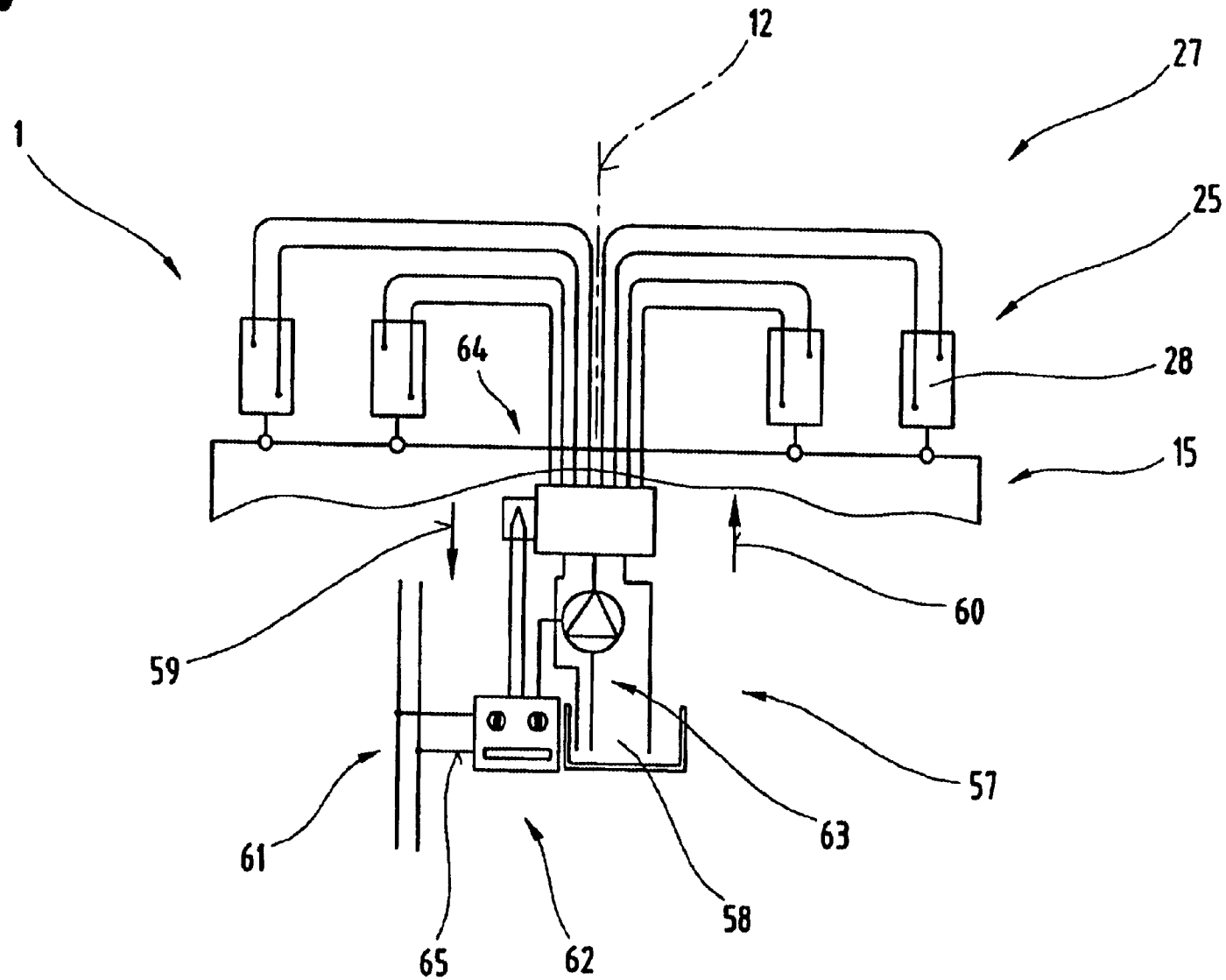
FIG. 3 is a simplified diagram showing a hydraulic system for operating the production machine proposed by the invention.

FIG. 3 is a simplified, schematic hydraulic diagram of the supply and control system 57 for the production machine 1 proposed by the invention. The displaceable press beam 15 in the embodiment illustrated as an example here is driven by four hydraulic cylinders 28. They are supplied with pressurising medium by the supply and control system 57 from a tank 58 for the pressurising medium, e.g. hydraulic oil, in order to run a working cycle, consisting of a working stroke—shown by arrow 59—and a return stroke—shown by arrow 60. To this end, the supply and control system 57 has a control unit 62 supplied by a power source 61, e.g. a power supply network, a known FPS for example, a pump unit 63, preferably a multi-stage pump, and a valve unit 64, as well as the lines 56.

The control unit 62 has line connections via supply and control lines 65 to the power source 61, pump unit 63 and valve unit 64. Although not illustrated, other devices additionally needed with this type of production machine 1 are also provided, for example safety devices, detection and evaluation units, which are also connected to the control unit 62.

With a supply and control system 57 of this type, pressure can be applied selectively to the hydraulic cylinders 28 depending on switching states in the valve unit 64. Accordingly, the hydraulic cylinders 28 can be pressurised jointly or individually in order to produce the effects described above, by means of which power usage and cycle times can be controlled to suit requirements.

Figure 4:
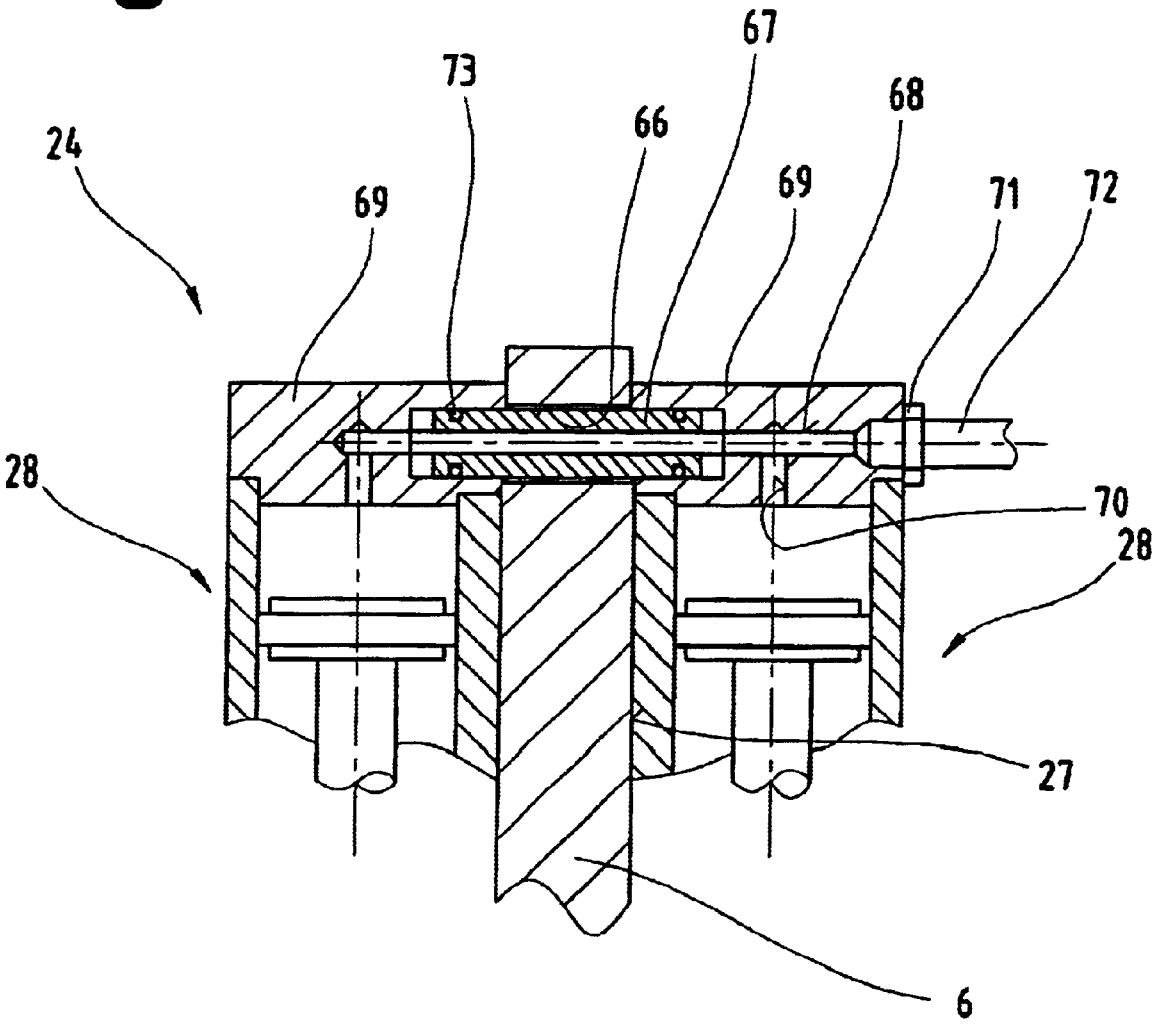
FIG. 4 is a view in partial section showing another embodiment of the production machine proposed by the invention for supplying hydraulic cylinders of the actuator drives in pairs.

FIG. 4 provides a detailed view of how one of hydraulic cylinders 28 constituting the actuator drives 24, 25 is supplied with pressurising medium, in this case taking the actuator drive 24 as an example. As described above, the hydraulic cylinders 28 are fixed to the supporting side walls 6, 7 on the side faces 22, 23. In order to supply them jointly with pressurising medium, they have line connections to a pressure pipe 67 crossing through the supporting side walls 6, 7 in an opening 66. The pressure pipe 67 forms a flow passage 68, which is in flow communication with connecting passages 70, preferably arranged in the cylinder end adapter 69. The connecting passages 70 communicate with pressure chambers of the hydraulic cylinders 28. At least one cylinder end adapter 69 of a hydraulic cylinder 28 to be jointly pressurised with pressurising medium via the flow communication with the pressure pipe 67 has an outwardly directed connection 71 for a pressure line 72 connected to the supply and control system. In end regions, the pressure pipe 67 is secured so as to project into the cylinder end adapters 69, made pressure-tight at the circumferential end by means of seals 73. An arrangement of this type, illustrated in FIG. 4, significantly simplifies mounting and installation where several hydraulic cylinders 28 are commonly supplied with pressurising medium. It should also be pointed out that the described connection with the pressure pipe 67 can be provided for both pressure chambers on both sides of a piston in the case of a double acting hydraulic cylinder.

For the sake of good order, it should be pointed out that in order to provide a clearer understanding of the structure of the production machine 1, it and its component parts are to a certain extent illustrated out of scale and/or on an enlarged scale and/or reduced scale.

The objectives of the independent inventive solutions may be found in the description.

Above all, the individual embodiments of the subject matter illustrated in FIGS. 1; 2; 3; 4 may be construed as independent solutions proposed by the invention. The objectives and solutions proposed by the invention may be found in the detailed descriptions of these drawings.

| List of reference numbers | |
|---|---|
| 1 | Production machine |
| 2 | Edging press |
| 3 | Sheet metal part |
| 4 | Section |
| 5 | Machine frame |
| 6 | Supporting side wall |
| 7 | Supporting side wall |
| 8 | Damping element |
| 9 | Standing surface |
| 10 | Bed plate |
| 11 | Distance |
| 12 | Mid-axis |
| 13 | Wall part |
| 14 | Working plane |
| 15 | Press beam |
| 16 | Press beam |
| 17 | Length |
| 18 | |
| 19 | Fixing arrangement |
| 20 | End face |
| 21 | Leg |
| 22 | Side face |
| 23 | Side face |
| 24 | Leg |
| 25 | Actuator drive |
| 26 | Actuator drive |
| 27 | Drive arrangement |
| 28 | Hydraulic cylinder |
| 29 | Actuator element |
| 30 | Guide arrangement |
| 31 | Articulated bearing |
| 32 | Bolt |
| 33 | End face |
| 34 | End face |
| 35 | Tool holder device |
| 36 | Bending tool |
| 37 | Bending tool |
| 38 | Die |
| 39 | Swage |
| 40 | Punch |
| 41 | Stamp |
| 42 | Tool length |
| 43 | Supporting surface |
| 44 | Arrow |
| 45 | Fixing element |
| 46 | Screw |
| 47 | Longitudinal mid-axis |
| 48 | Piston rod |
| 49 | Cylinder jacket |
| 50 | Side face |
| 51 | End region |

-continued

| List of reference numbers | |
|---|---|
| 52 | Supporting surface |
| 53 | Projection |
| 54 | Bearing surface |
| 55 | Arrow |
| 56 | Line |
| 57 | Supply and control system |
| 58 | Tank |
| 59 | Arrow |
| 60 | Arrow |
| 61 | Power source |
| 62 | Control unit |
| 63 | Pump unit |
| 64 | Valve unit |
| 65 | Supply and control line |
| 66 | Opening |
| 67 | Pressure pipe |
| 68 | Flow passage |
| 69 | Cylinder end adapter |
| 70 | Connecting passage |
| 71 | Connection |
| 72 | Pressure line |
| 73 | Seal |

What is claimed is:

1. A press for shaping sheet metal parts, comprising:

a frame formed by a pair of parallel side plates spaced-apart in a transverse direction of the press, each side plate having a generally C-shaped configuration defining two opposing legs spaced apart in a pressing direction perpendicular to the transverse direction, the frame further comprising at least one wall joined to and extending between the side plates;

a stationary press beam mounted on the frame and extending in the transverse direction for supporting a first bending tool;

a displaceable press beam supported in a guide arrangement of the frame such that the displaceable press beam is movable in the pressing direction toward and away from the stationary press beam, the displaceable press beam being structured and arranged to support a second bending tool for cooperating with a first bending tool on the stationary press beam to shape a sheet metal part disposed between the press beams;

a first leg of each side plate having opposite side faces that face in the transverse direction and a supporting surface facing in the pressing direction;

a drive arrangement secured in the frame and operable for moving the displaceable press beam toward and away from the stationary press beam, the drive arrangement comprising actuator drives mounted on side faces of the first legs of the side plates and drivingly connected to the displaceable press beam, the actuator drives having projections forming bearing surfaces that abut the supporting surfaces of the first legs such that reaction forces on the actuator drives generated during a pressing operation are directly transmitted into the side plates through the supporting surfaces thereof.

2. The press of claim 1, wherein the drive arrangement comprises four actuator drives, each side plate having two of the actuator drives mounted respectively on the opposite side surfaces of the first leg.

3. The press of claim 1, wherein the actuator drives are arranged in pairs having matched output capacity.

4. The press of claim 1, wherein the actuator drives comprise hydraulic cylinders, and further comprising a supply and control system operable to supply pressurizing medium to the hydraulic cylinders.

5. The press of claim 4, wherein the supply and control system is structured and arranged so that the hydraulic cylinders can be selectively pressurized with pressurizing medium individually, in pairs, or all together.

6. The press of claim 4, wherein the supply and control system has two supply circuits for the pressurizing medium to actuator the hydraulic cylinders.

7. The press of claim 4, wherein the supply and control system comprises a control unit and a valve unit for selectively pressurizing the hydraulic cylinders.

8. The press of claim 4, wherein the projections of the actuator drives that form the bearing surfaces are integrally formed on a cylinder jacket of each hydraulic cylinder.

9. The press of claim 8, wherein the cylinder jackets have a quadrangular shape in external cross-section.

10. The press of claim 8, wherein the cylinder jackets have a substantially circular external cross-section.

11. The press of claim 4, wherein two hydraulic cylinders are mounted respectively on the opposite side faces of each side plate and are arranged so as to be commonly pressurized with pressurizing medium.

12. The press of claim 11, wherein the commonly pressurized hydraulic cylinders are connected to a pressure pipe that extends through an aperture formed in the respective side plate on which the hydraulic cylinders are mounted, the pressure pipe defining a flow passage for supplying pressurizing medium to each of the hydraulic cylinders.

13. The press of claim 12, wherein the flow passage of the pressure pipe is connected to pressure chambers of the hydraulic cylinders via connecting passages extending therebetween.

14. The press of claim 13, wherein the connecting passages are defined in cylinder end adaptors of the hydraulic cylinders.

15. The press of claim 14, wherein at least one cylinder end adaptor has a line connection to the supply and control system.

16. The press of claim 1, wherein the actuator drives are affixed to the side plates by one of inserted springs, locating pins, foot mountings, and articulated arrangements.

* * * * *